US010721974B2

(12) United States Patent
Bastug

(10) Patent No.: US 10,721,974 B2
(45) **Date of Patent: *Jul. 28, 2020**

(54) LIGHT WEIGHT SUPPORTIVE BRA

(71) Applicant: Gelmart Industries, Inc., New York, NY (US)

(72) Inventor: Eve Bastug, North Haledon, NJ (US)

(73) Assignee: Gelmart Industries, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/278,853

(22) Filed: Feb. 19, 2019

(65) Prior Publication Data

US 2019/0174841 A1 Jun. 13, 2019

Related U.S. Application Data

(63) Continuation-in-part of application No. 15/822,861, filed on Nov. 27, 2017, now Pat. No. 10,231,492.

(51) Int. Cl.

| | |
|---|---|
| ***A41C 3/00*** | (2006.01) |
| ***A41C 3/14*** | (2006.01) |
| ***A41C 3/12*** | (2006.01) |
| *A41F 1/00* | (2006.01) |

(52) U.S. Cl.

CPC ..... *A41C 3/0057* (2013.01); *A41C 3/0007* (2013.01); *A41C 3/12* (2013.01); *A41C 3/144* (2013.01); *A41F 1/006* (2013.01)

(58) Field of Classification Search

CPC ..... A41C 3/10; A41C 3/0014; A41C 3/0057; A41C 3/144

USPC ..... 450/39, 1

See application file for complete search history.

(56) References Cited

U.S. PATENT DOCUMENTS

| | | | | |
|---|---|---|---|---|
| 2,289,679 | A * | 7/1942 | Porter | A41C 3/144 450/57 |
| 2,524,620 | A * | 10/1950 | Cadous | A41C 3/06 450/41 |
| 2,628,356 | A * | 2/1953 | Rosenfield | A41C 3/06 450/41 |
| 2,988,087 | A * | 6/1961 | Krieger | A41C 3/06 450/81 |
| 3,254,653 | A * | 6/1966 | Krieger | A41C 3/00 450/39 |
| D300,382 | S | 3/1989 | Keithan | |
| D381,188 | S | 7/1997 | Allen | |

(Continued)

OTHER PUBLICATIONS

Aerie Brand Bra Photo, Mar. 2017.

(Continued)

*Primary Examiner* — Gloria M Hale

(74) *Attorney, Agent, or Firm* — Dilworth & Barrese, LLP

(57) ABSTRACT

A breast supporting garment such as a shirt, bra or similar garment has a body section having a front bust section for supporting a woman's breasts. A band of elastic material is provided under the bust section for shape and support. Another band of elastic material is provided around the bottom of the garment and helps keep it from riding up. The bust section of the garment should be formed from two layers of fabric adhered with elastomeric adhesive. The fabric should be free cut knit fabric having a high level of spandex. The bra will be lightweight and free feeling, as if it is not there.

20 Claims, 8 Drawing Sheets

(56) References Cited

U.S. PATENT DOCUMENTS

| | | | | |
|---|---|---|---|---|
| 5,820,443 | A * | 10/1998 | Burr | A41C 3/0014 450/40 |
| 6,332,825 | B1 * | 12/2001 | Henricksen | A41C 3/0057 450/1 |
| D452,601 | S | 1/2002 | Allen et al. | |
| 6,446,268 | B1 * | 9/2002 | Lazarian | A41B 11/126 2/237 |
| D503,510 | S | 4/2005 | Oya et al. | |
| 7,228,809 | B2 * | 6/2007 | Angelino | A41D 27/245 112/440 |
| 7,422,508 | B2 * | 9/2008 | Bentham | A41C 3/0014 2/243.1 |
| D594,631 | S | 6/2009 | Reinisch | |
| 7,682,219 | B2 * | 3/2010 | Falla | A41B 17/00 450/92 |
| D641,954 | S | 7/2011 | Glass | |
| D646,461 | S | 10/2011 | Lewando | |
| 8,128,457 | B2 | 3/2012 | Reinisch et al. | |
| D668,430 | S | 10/2012 | Martin | |
| D671,296 | S | 11/2012 | Iamartino | |
| 8,684,789 | B2 * | 4/2014 | Gramelspacher | A41C 3/065 450/81 |
| D762,044 | S | 7/2016 | Adachi et al. | |
| 9,516,905 | B2 * | 12/2016 | Pagnon | A41C 3/10 |
| D784,653 | S | 4/2017 | Yamamoto et al. | |
| 10,231,492 | B1 * | 3/2019 | Bastug | A41C 3/0007 |
| 2003/0040256 | A1 * | 2/2003 | Waitz | A41C 3/12 450/86 |
| 2003/0186620 | A1 * | 10/2003 | Kaye | A41F 15/005 450/86 |
| 2005/0020184 | A1 * | 1/2005 | Izcoa | A41C 3/12 450/86 |
| 2005/0266770 | A1 * | 12/2005 | Henricksen | A41C 3/0007 450/1 |
| 2006/0223415 | A1 * | 10/2006 | Watrin | A41C 3/0014 450/39 |
| 2007/0021035 | A1 * | 1/2007 | Bugada | A41C 3/0014 450/39 |
| 2010/0144242 | A1 | 6/2010 | Allen et al. | |
| 2010/0267313 | A1 | 10/2010 | Allen et al. | |
| 2011/0143633 | A1 * | 6/2011 | Zhang | A41C 3/14 450/39 |
| 2012/0225607 | A1 * | 9/2012 | Martinet | A41C 3/126 450/41 |

OTHER PUBLICATIONS

Fruit of the Loom Brand Bra Photo, Jan. 2000.
Sloggi Brand Bra Photo, Tokyo, Japan Mar. 2014.
Uniqlo Brand Bra Photo, Jul. 2017.
Wacoal Brand Bra Photo, Jan. 2013.
Hanes Brand Bra Photo, Mar. 2016.

* cited by examiner

LIGHT WEIGHT SUPPORTIVE BRA

CROSS REFERENCE TO RELATED APPLICATIONS

This application claims priority as a continuation-in-part of Ser. No. 15/822,861, filed Nov. 27, 2017, the entire contents of which are incorporated herein by reference.

BACKGROUND OF THE INVENTION

The invention relates generally to a brassiere, also commonly called a bra, as well as other garments providing the same functions.

Bras are commonly worn by women to provide support for their breasts and for enhanced shape and appearance. Other garments have built-in bras and can provide the same function. Bras are often constructed to provide different amounts of support. Often, conventional bra constructions require a choice to be made by a wearer of the bra between support and comfort. For example, some women find certain bras to be too restrictive. Sometimes, they find the fabric to be uncomfortable. Some Bras are made with an underwire design. Some women find the underwire to be uncomfortable. Some bras have a tendency to "ride-up" and are tugged-on repeatedly during the day.

Other types of bras, such as bras with a sports bra type of construction, reduce natural movement of the breasts more than might be desirable for certain situations. Other bras that supply relatively high support can lead to an unnatural, restricted appearance and often impose their own shape on the natural shape of the breast or flatten the breasts against a woman's chest. Other bras, especially those with shaping pads, can feel clammy.

Accordingly, it is an object of the invention to provide a bra that overcomes drawbacks, inadequacies and limitations of the prior art.

SUMMARY OF THE INVENTION

Generally speaking, in accordance with the invention, a lightweight, but supportive garment constructed to support the breasts of a user wearing the garment, such as a bra, tank top, shirt, leotard, sports bra or other garment is provided to overcome deficiencies of the prior art. The bra can be formed with a front half and a rear half, having a top and a bottom. One or two shoulder straps can extend from the top of the front half to the top of the rear half.

The garment can be formed from a front half and a rear half. The top ends of respective shoulder strap halves of the front panel can be attached to respective top ends of shoulder strap halves of the rear panel, at two shoulder strap seams, to form two shoulder straps. The side edges of the front panel can be attached to respective side edges of the rear panel, at side seams, to form a body section. The two shoulder straps connected to the body section define two arm holes at the area above the side seams. The shoulder straps and the top edges of the front and rear panels define front and rear necklines.

An inner front panel of fabric can be attached as a second fabric layer to overlap an inner surface of the front panel to form a bust section of the bra. For example, the inner front panel can overlap the shoulder strap halves of the front panel and extend down towards, but not all the way to the bottom edge. The inner front panel can be positioned across the front panel, extending toward, but not reaching the side seams.

The inner front panel is positioned to overlap and contain the breasts of a wearer of the bra.

The bra should be formed from free cut knit fabric. Preferred fabrics have a high level of spandex. The bra includes strategically positioned bonded film strips of elastomeric adhesive between two layers of fabric to provide supportive resilient function. The adhesive is preferably urethane based adhesive, especially ester modified urethane adhesive. For example, a curved bonded film of adhesive can be provided between the front panel and the inner front panel (second layer), at a position to be at the bottom of the bust section of the bra, at a location that would be under a wearer's breasts. A center front strip can be provided between the front panel and the inner front panel to separate the bust section into left and right cups or pad holding pockets. A bottom band can be provided by folding the bottom edge of the front and rear panels into a hem and disposing adhesive in the fold to create a resilient band entirely around the bottom edge of the bra. Adhesive can also be used to bond the fabric layers of the front panel and rear panel at the side seams. An adhesive band can also be formed at the front neckline at the top edges of the front panel and inner front panel and at the arm holes where the inner front panel overlaps the front panel.

In an embodiment of the invention, a slit for receiving cup pads between the front panel and inner front panel can be provided, preferably through the inner front panel. The cup pads can be formed from foam material, for enhanced shaping and coverage properties. The pads are preferably perforated for moisture control. It is advantageous to cover the pads with non-absorbent fabric, such as polyester knit.

In another embodiment of the invention, the front and back panels can be formed of two ply fabric having a body section and a pair of shoulder straps extending up from the body section. The inner edges of the shoulder straps define front in rear necklines and the outer edges of the shoulder straps define arm holes. The bottom hem of the body portion can be doubled. The rear body section can be split and releasably attached with an attachment mechanism connected to each half. Foam cups cam be attached to the inner surface of the front body section.

Preferred adhesives for forming the bonded film strips discussed above, between two layers of fabric, whether folded or overlapping, include ester modified polyurethane adhesives. The adhesive strips generally have a thickness of about 20-30, preferably about 23-28, more preferably about 25 μm (0.001 inches). The density of the adhesive strips should be about 30-40, preferably about 25-35, more preferably about 31 g/m$^2$. The width of the adhesive strips is generally about 0.5 to 2.5 cm. The bands should be elastic, lay flat when the bra is worn and be minimally visible.

A strip of adhesive can be placed between the front panel and inner front panel to define the lower extent of the bust section of the front of the bra. This under-bust strip is preferably flat, about 1-2 cm, preferably about 1.25-1.75 cm wide, more preferably about 1.3-1.6 cm wide most preferably about 1.4 cm wide. This strip provides flexible, expandable support of the breasts and is generally considered more comfortable than an under wire.

A central strip can separate the bust section into individual left and right cups or pad pockets. This central strip is preferably flat and about 1-2 cm, more preferably about 1.25-1.75 cm wide, most preferably about 1.4 cm wide.

The fabric for a bra in accordance with the invention is preferably free cut knit material. Free cut knits do not unravel at unfinished edges thereof. Free cut fabric eliminates the need for bulky finishing at the edges. Such finishing can interfere with comfort and can show through clothing and make the bra more visible. The fabric is advantageously a combination of nylon or polyester with spandex. The nylon is preferably 20D nylon yarn and the spandex is preferably 30D spandex. The fabric should be formed with at least about 15%, preferably at least 25% and most preferably at least 30% spandex. A 40 gauge knitting machine is preferred. The fabric should have a density between about 100 and 200 g/m$^2$, preferably about 145 to 165 g/m$^2$, most preferably about 155 g/m$^2$.

The fabric is preferably subjected to a moisture management treatment. The fabric should be treated after dyeing and finishing. Preferred treatment involves a bath of hydrophilic silicone, preferably hydrophilic silicone oil type 919. Preferred silicone treatments comprise modified amino silicone oils with small percentages of penetrating agent (e.g., ternary polymerization). Hydrophilic amino modified silicone should be selected that give the fabric a feather-like softness feel and smoothness with improved moisture wicking capabilities. PH values for preferred silicone treatment material ranges from 5.5-6.5. Preferably, it does not contain Nonylphenol & Octylphenol Polyoxyethylene.

Accordingly, it is an object of the invention to provide a bra and an improved method of making a bra.

Still other objects of the invention will in part be obvious and will, in part be apparent from the specification and drawings. The invention accordingly comprises the article of manufacture and the method of making the article which will be exemplified in the articles and methods hereinafter described, and the scope of the invention will be indicating the claims.

BRIEF DESCRIPTION OF THE DRAWINGS

For a fuller understanding of the invention, reference is had to the following description, taken in connection with the accompanying drawings, in which.

As used herein, identical reference numerals will indicate similar structures. The drawings, which are not necessarily drawn to scale, are for purposes of illustration only and are not intended to be interpreted as limiting the scope of the invention.

DETAILED DESCRIPTION OF THE PREFERRED EMBODIMENTS

Figure 1:
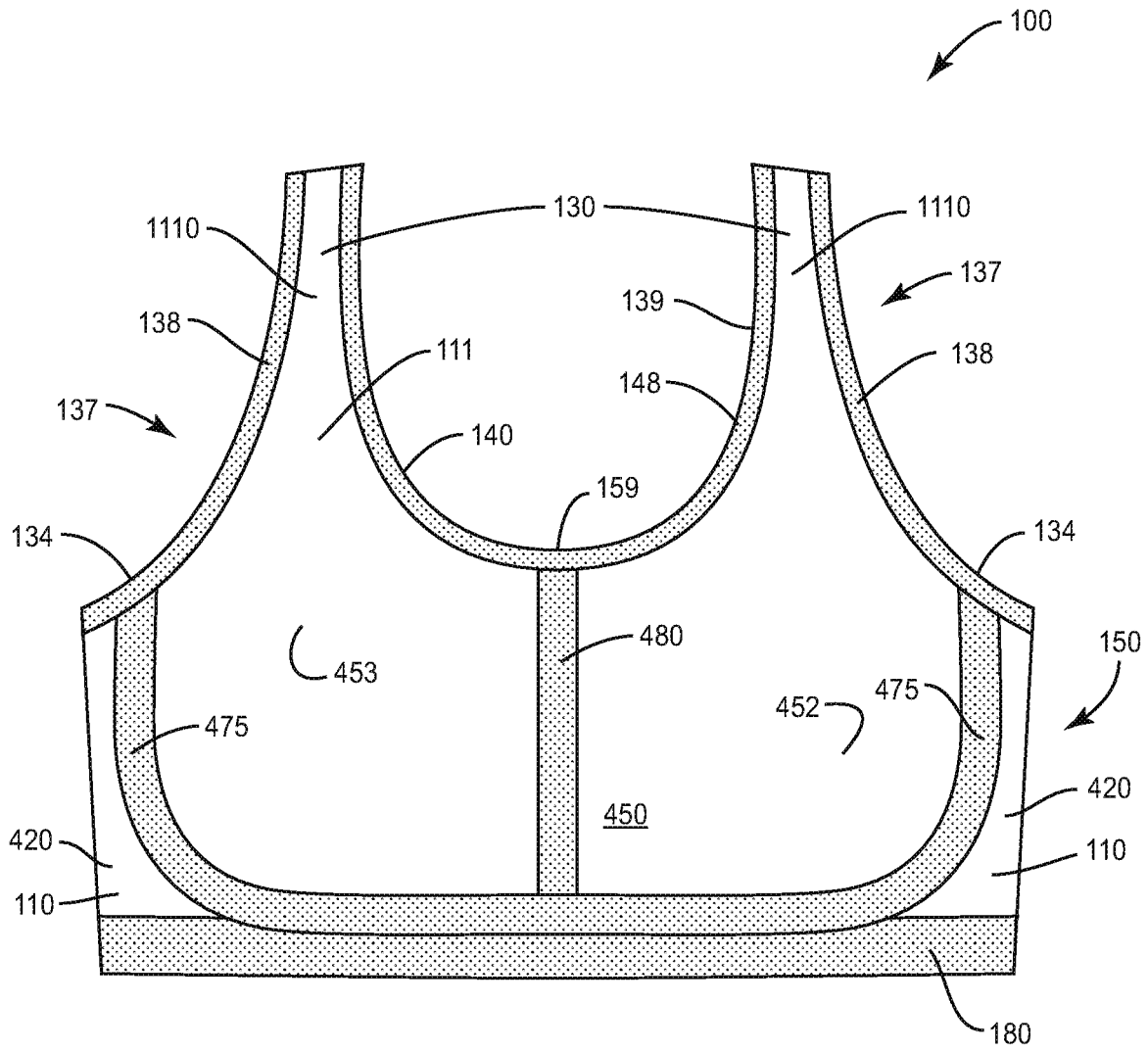
FIG. 1 is front view of a bra in accordance with a preferred embodiment of the invention.
Figure 2:
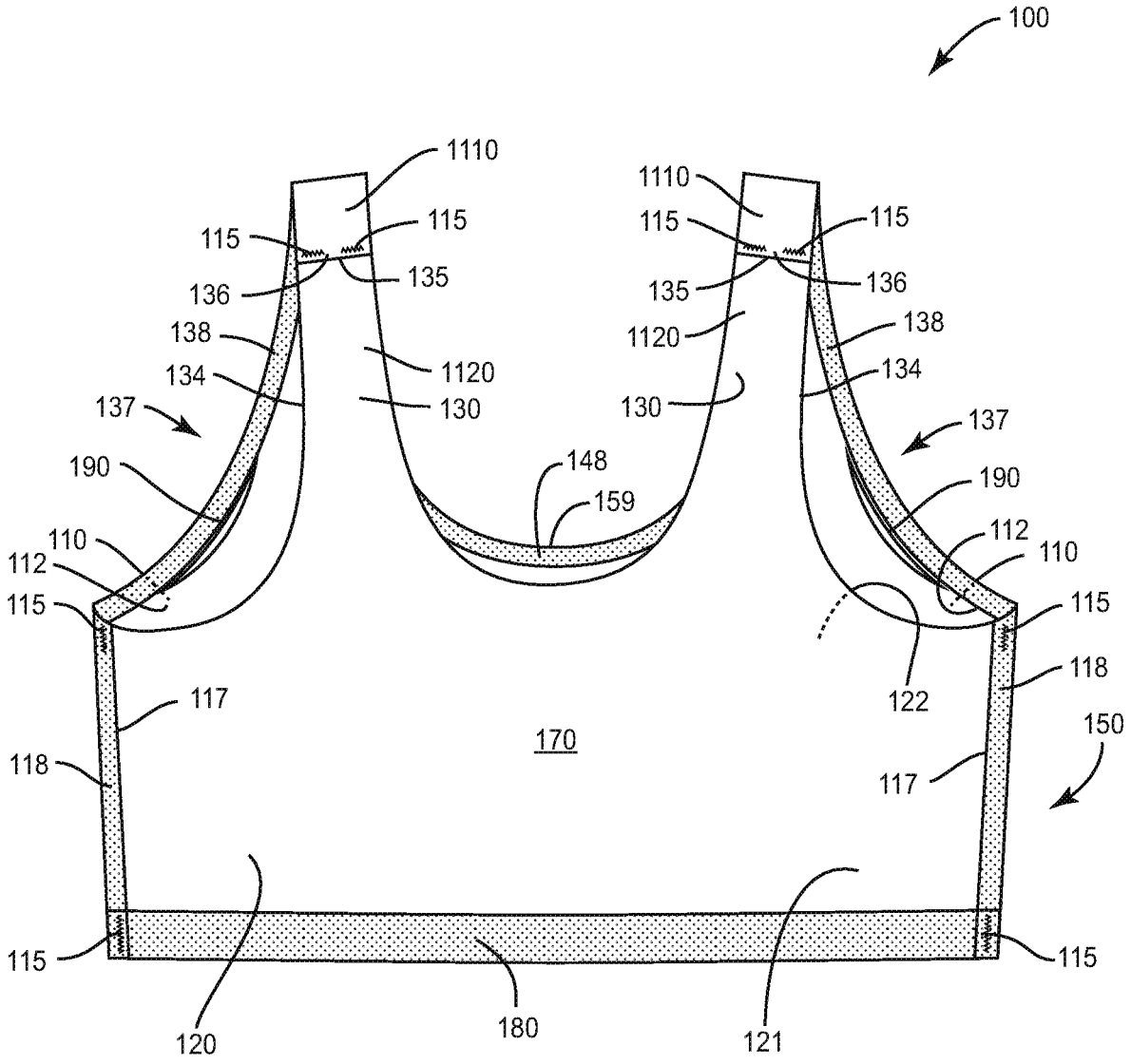
FIG. 2 is a rear view of the bra of FIG. 1.

A garment constructed to support the breasts of a user wearing the garment in accordance with a preferred embodiment of the invention is shown generally in FIGS. 1-4 as bra 100. Bra 100 can be formed from any type of fabric, but sheer synthetic knit blends are preferred. Bra 100 is formed with a front panel 110 and a rear panel 120. Rear panel 120 is shown more clearly in FIG. 2. The side edges of front panel 110 and rear panel 120 are connected to each other by a plurality of bar tacks 115, for added security at strategic locations.

Front panel 110 comprises an outer front surface 111 and an inner front surface 112. Rear panel 120 comprises an outer rear surface 121 and an inner rear surface 122. An overlapped side seam 117 is present where front panel 110 meets rear panel 120. It is preferred for front panel 110 to be over rear panel 120 at side seam 117.

A side seam bonded film 118 is located between inner front surface 112 and outer rear surface 121 where front panel 110 overlaps rear panel 120. As used herein, the layer of adhesive between two layers of fabric will be shown as a stippled strip. Those of ordinary skill will appreciate that the strip is a bonded film and not a layer on an outside surface. However, it will be depicted in this manner so that the location of the strips of adhesive will be apparent, even though they are covered.

Side seam bonded film 118 is a 1.3 cm wide flat strip of elastomeric adhesive between two layers of fabric. In alternative embodiments of the invention, side seam bonded film 118 can be about 1.0 to 1.5 cm wide, more preferably 1.2 to 1.4 cm wide. Other dimensions are acceptable.

A pair of front shoulder strap portions 1110 extend from the top of front panel 110. A pair of rear shoulder strap portions 1120 extend from the top of rear panel 120. Front shoulder strap portions 1110 are joined to rear shoulder strap portions 1120 at a shoulder strap seam 135. Shoulder strap seam 135 is an overlap seam, but other constructions are possible. A strip of shoulder seam adhesive (bonded film) 136 is present between the edges of front shoulder strap portion 1110 and rear shoulder strap portion 1120 at each shoulder strap seam 135. Front shoulder strap portion 1110 preferably lays over rear shoulder strap portion 1120 at the rear side of bra 100.

Shoulder seam adhesive strip 136 is a 1.2 cm wide bonded film. The film is approximately 25 μm (0.001 inches) thick and has a density of about 31 g/m$^2$. In alternative embodiments of the invention, the strip of shoulder seam adhesive can be about 1-1.5 cm wide, preferably 1.1-1.3 cm wide; and about 20 to 30 μm thick. Other dimensions are acceptable.

Figure 3:
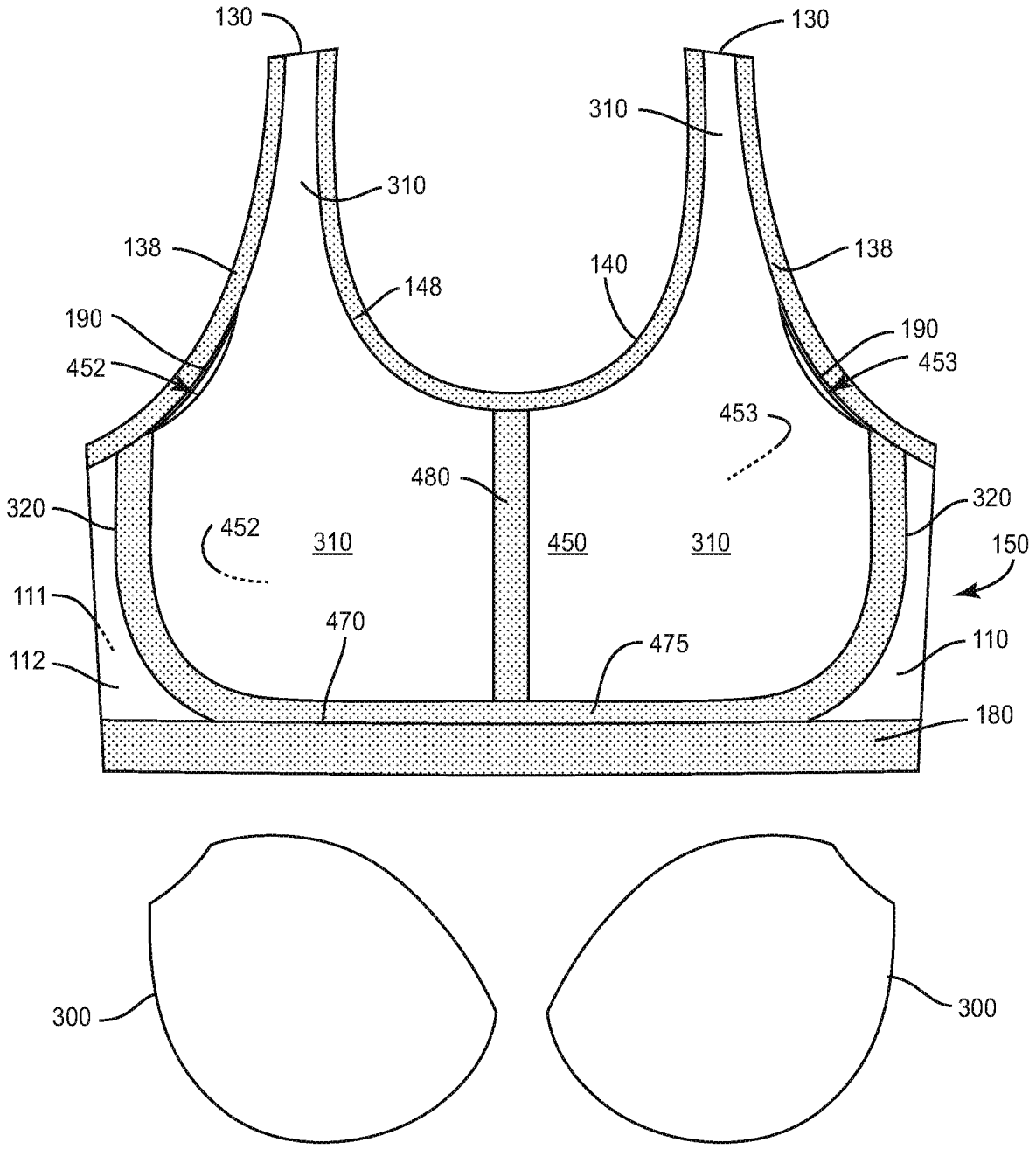
FIG. 3 is a cutaway rear view of the inside of the front of the bra of FIG. 1, including a rear view of pads that can be inserted therein, in accordance with a preferred embodiment of the invention.

Referring to FIG. 3, a fabric second layer 310 is applied to overlap most of inside surface 112 of front panel 110. Second layer 310 improves the opacity of the front of bra 100. Second layer 310 overlaps front shoulder strap portion 1110. It also overlaps most of front panel 110, except at the bottom and sides. A second layer seam 320 is formed at the edge of second layer 310, where it does not overlap inside surface 112, which remains exposed. Second layer 310 forms a two ply a bust section 450, located to cover and support a wearer's breasts.

Bra 100 includes a body section 150 located below shoulder straps 130. Bra 100 also includes a back section 170 located below shoulder straps 130 on rear panel 120. An inner edge 139 of front shoulder strap portion 1110 and a top edge 159 of body section 150 define a front neckline 140. An outer edge 134 of shoulder straps 130 define a pair of arm holes 137.

An armhole film 138, formed as a strip of elastomeric adhesive, is present between front panel 110 and second layer 310, along outer edge 134 of front panel 110, defining part of armhole 137, where an edge of inner front surface 112 meets an edge of second layer 310. A neckline film 148, formed as a strip of elastomeric adhesive, is present between the fabric of front panel 110 and second layer 310 along top edge 159. Armhole film 138 and neckline film 148 are 1.4 cm wide bonded films and can be similar in construction to shoulder seam film 115. In alternative embodiments of the invention, the armhole film and/or the neckline film can be about 1 to 2 cm wide, preferably 1.25-1.75 cm wide, more preferably about 1.3 to 1.5 cm wide. These films should be approximately 20-30 μm preferably about 25 μm thick and have a density of about 25-35, preferably 31 g/m$^2$. Other dimensions are acceptable.

Figure 4:
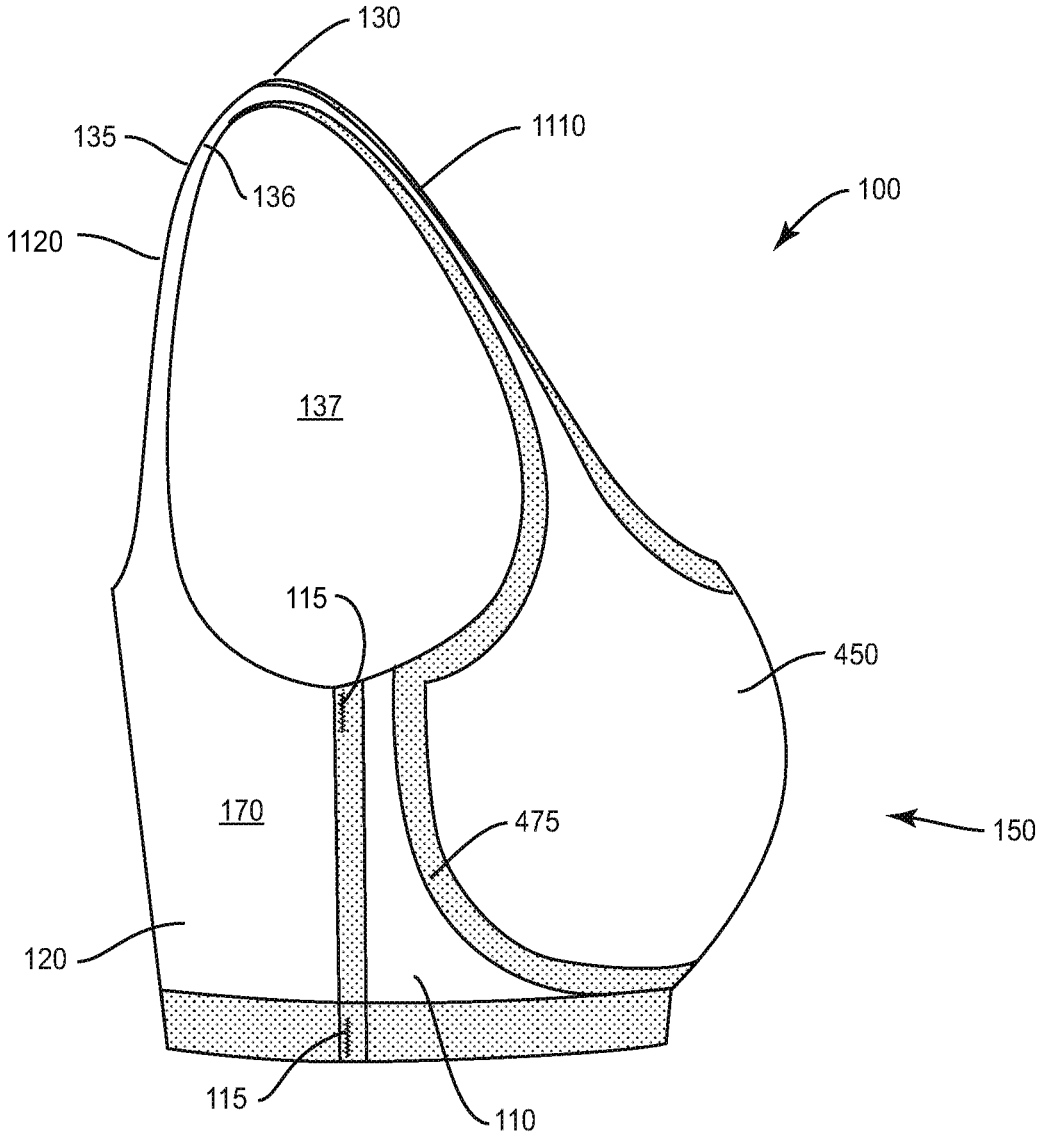
FIG. 4 is a side view of a bra of FIG. 1.
Figure 5:
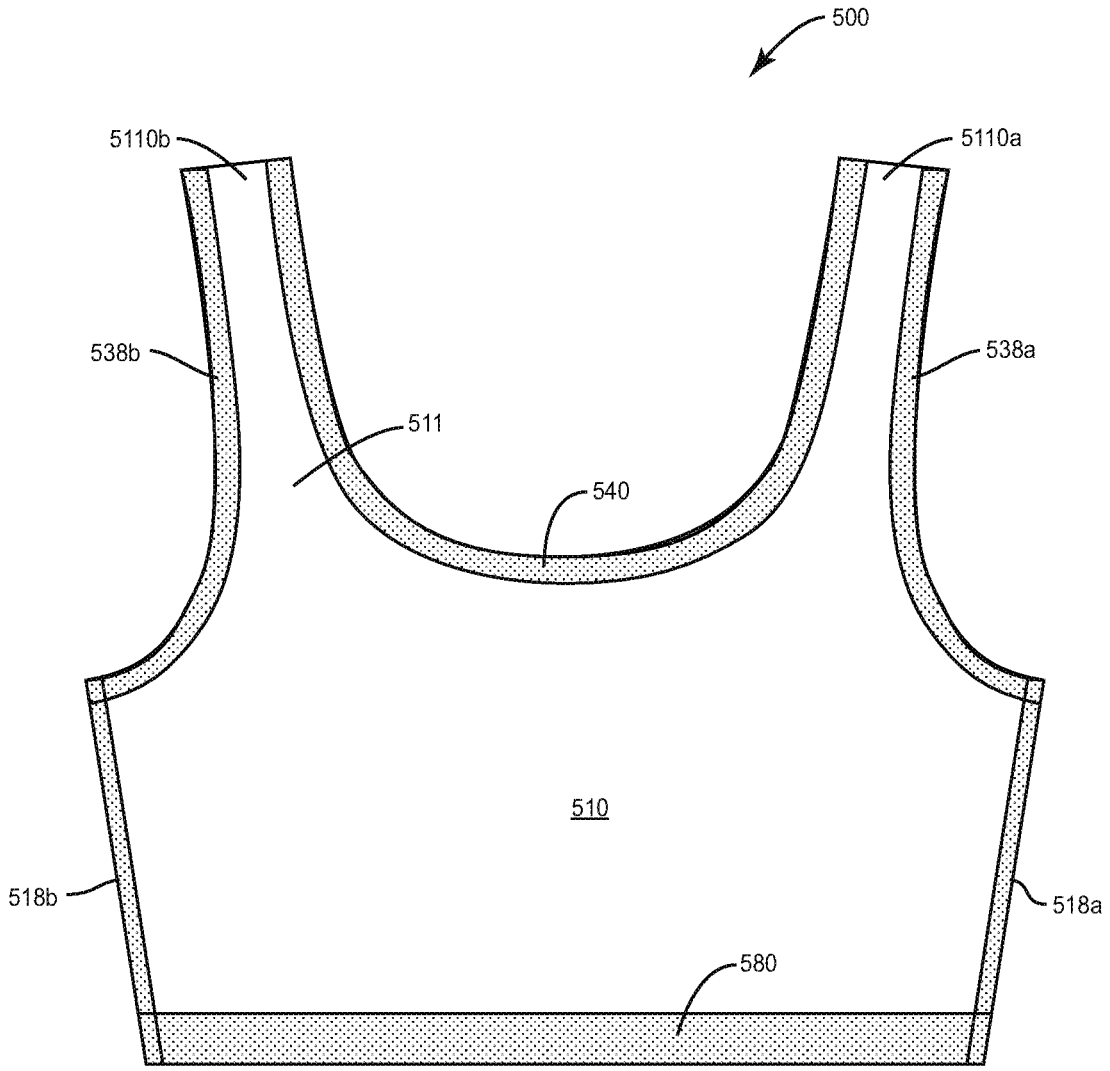
FIG. 5 is front view of a bra in accordance with another preferred embodiment of the invention.

Referring to FIG. 4, body section 150 includes a rib portion 420 and a bust portion 450. Rib portion 420 comprises the portion of front panel 120 that is not backed by second layer 310. Bust portion 450 is a two-ply fabric portion, where front panel 120 and second layer 310 are joined together at side seam bonded film 118, armhole film 138 and an under bust film 475. Under bust film 475 is formed as a bonded film of elastomeric adhesive. It is present along an under bust seam 470 between the lower edge of second layer 310 and inside surface 112. Under bust film 475 is 1.4 cm wide. In alternative embodiments of the invention, the under bust film can be about 1 to 2 cm wide, preferably 1.25-1.75 cm wide, more preferably about 1.3 to 1.5 cm wide.

Under bust film 475 performs a similar supportive function as an underwire. However, because it is flat, thin and elastic, under bust film 475 can feel more comfortable than a conventional underwire. The fabric of bust portion 450 between under bust film 475 and neckline 140 should be contoured, for proper shaping and support, to match the shape of a wearer's breasts.

Bra 100 also includes a center front bonded film 480, bonding inner front surface 112 to second layer 310 and forming a pair of pad holder pockets 452 and 453 therebetween, accessible by a pair of respective slits 190. Center front bonded film 480 extends from neckline 140 to under bust film 475. Center front film 480 bisects bust portion 450 into a left pad holder pocket 452 and a right pad holder pocket 453. Center front bonded film 480 is about 1.5 cm wide. In alternative embodiments of the invention, it can be from 1 to 2 cm wide, preferably 1.25 to 1.75 cm wide, more preferably 1.4 to 1.6 centimeters wide.

Bottom band 180 can be formed as a bonded flat film of elastomeric adhesive between the two plies of fabric. The inside of bottom band 180 can be textured or otherwise modified to prevent bra 100 from riding up. The bonded film forming bottom band 180 can comprise the same elastomeric adhesive having the same density and thickness, as discussed above. The film should be approximately about 20-30 μm preferably about 25 μm thick and have a density of about 25-35, preferably about 31 g/m$^2$. Bottom band 180 comprises an about 2 cm wide bonded film. In alternative embodiments of the invention, the bonded film can be about 1 to 2.5 cm wide, preferably 2.25 to 1.75 cm wide, more preferably about 1.9 to 2.1 centimeters wide.

As shown more clearly in FIG. 3, a pair of pad slits 190 are provided to provide access to the space between second layer 310 and front panel 110. Slits 190 are configured to receive a pair of removable foam pads 300. Pad slits 190 are optional and preferably about 2 inches long. The dimensions of pad slits 190 can vary with the dimensions and properties of pads 300.

Foam pads 300 are molded for both shaping, coverage and support as desired. The inner and outer surfaces of foam pads 300 are preferably laminated with moisture-proof fabric, such as 100% polyester fabric. In addition, the pads can be perforated, preferably every 0.25 inches from each other. These perforations help permit body moisture to evaporate through the pads.

The fabric for bra 100 is preferably a synthetic free cut fabric with a high spandex content. It can be formed from natural fibers or preferably various fabric polymers, such as polyester, nylon and different polymer blends. Preferably, the fabric is a nylon/spandex (elastane) blend. Advantageous fabrics comprise at least about 15% spandex, preferably at least 25% spandex and most preferably at least 30% spandex. The fabric should be knit in a free cut fashion, which does not unravel at unfinished ends thereof. A 40 gauge knitting machine is preferred. The material should have a density between about 100 and 200 g/m$^2$, preferably about 145 to 165 g/m$^2$, most preferably about 155 g/m$^2$.

Another garment constructed to support the breasts of a user wearing the garment in accordance with a preferred embodiment of the invention is shown generally in FIGS. 5-8 as a rear-closing bra 500. Bra 500 can be formed from any type of fabric, but sheer synthetic knit blends are preferred. Materials and methods of forming bra 500 are similar to those of bra 100. Bra 500 is formed with a front panel 510 and a pair of left and right (from the perspective of a user/wearer) rear panels 520*a* and 520*b*, respectively. Rear panels 520*a* and 520*b* are shown more clearly in FIG. 6. Alternatively, the rear of bra 500 can be a continuous sheet of fabric to be pulled over the head of a wearer.

Panels 510, 520*a* and 520*b* are two-ply fabric panels having an inner layer facing the wearer and an outer layer facing away from the wearer. The outer edges of each ply are attached to each other at a front neckline 540 with a strip of adhesive. The adhesive for bonding the two layers of fabric is similar to that described with reference to bra 100 and is discussed more fully herein.

The outer edges of each ply of panels 520*a* and 520*b* are bonded to each other at a left rear neckline 545*a* and a right rear neckline 545*b*. The outer edges of each ply are also adhered to each other at a left front armhole edge 538*a*, a right front armhole edge 538*b*, a left rear armhole edge 538*c*, and a right rear armhole edge 538*d*.

The opposite edges where front panel 510 meets rear panels 520*a* and 520*b* are attached with adhesive at a left side seam 518*a* and a right side seam 518*b*. The side edges of front panel 510 and rear panels 520*a* and 520*b* are also reinforced with a plurality of bar tacks 515, for added security at strategic locations. It is preferred for front panel 510 to be over rear panels 520*a* and 520*b* at side seams 518*a* and 518*b*.

It is preferred that the attachments with adhesive strips essentially comprise a strip of elastomeric adhesive and no other attachment means, other than optional bar tacks. The use of the adhesive strips promotes comfort and ease of movement, because the adhesive stretches and contracts with the fabric. The bar tacks are small and do not interfere with this elastic movement. Thus, excessive sewing, non-elastic bonding or use of non-elastic materials should be avoided. Embodiments wherein the front section and rear section are formed as a continuous sheet of fabric are also possible. In these embodiments, the side seam and side adhesive are not needed.

The front attaches to the rear with a continuous length of fabric.

A pair of front shoulder strap portions 5110*a* and 5110*b* extend from the top of front panel 510. A pair of rear shoulder strap portions 5120*a* and 5120*b* extend from the top of rear panels 520*a* and 520*b*. Front shoulder strap portions 5110*a* and 5110*b* are joined to rear shoulder strap portions 5120*a* and 5110*b* at a pair of shoulder strap seams 535*a* and 535*b*. Shoulder strap seams 535*a* and *b* are an overlap seam, but other constructions are possible. A strip of shoulder seam adhesive (bonded film) 536 is present between the edges of front shoulder strap portions 5110*a* and *b* and rear shoulder strap portion 5120*a* and *b* at each shoulder strap seam 535*a* and 535*b*. Front shoulder strap portions 5110*a* and *b* preferably lays over rear shoulder strap portions 5120*a* and *b* at the rear side of bra 500.

In another embodiment of the invention, the attachment of the front shoulder strap to the rear shoulder strap is in the form of a continuous web of fabric. Such a construction can be more complicated, but does not require the adhesive strip.

The bottom edge of bra 500 includes a bottom band 580. The outer layer of front panel 510 and rear panels 520*a* and *b* is slightly longer (1-2.5 cm, preferably 1.5-2.2 cm, most preferably about 2 cm) than the inner fabric layer. The one-ply longer bottom of the outer layer is folded inwardly and attached to the inner surface of the inner layer to form a three-layer hem of the two-ply fabric. A strip of elastic adhesive is disposed in the space between the layers to form bottom band 580, which can extend completely around the bottom edge of bra 500. Bottom band 580 provides additional structure and support to bra 500. In addition, bottom band 580 helps prevent bra 500 from riding up a wearer. The inside of bottom band 580 can be textured or otherwise modified to prevent bra 500 from riding up. Bottom band 580 also provides a more structured gripping portion to help adjust the placement of bra 500 on a wearer.

Figure 6:
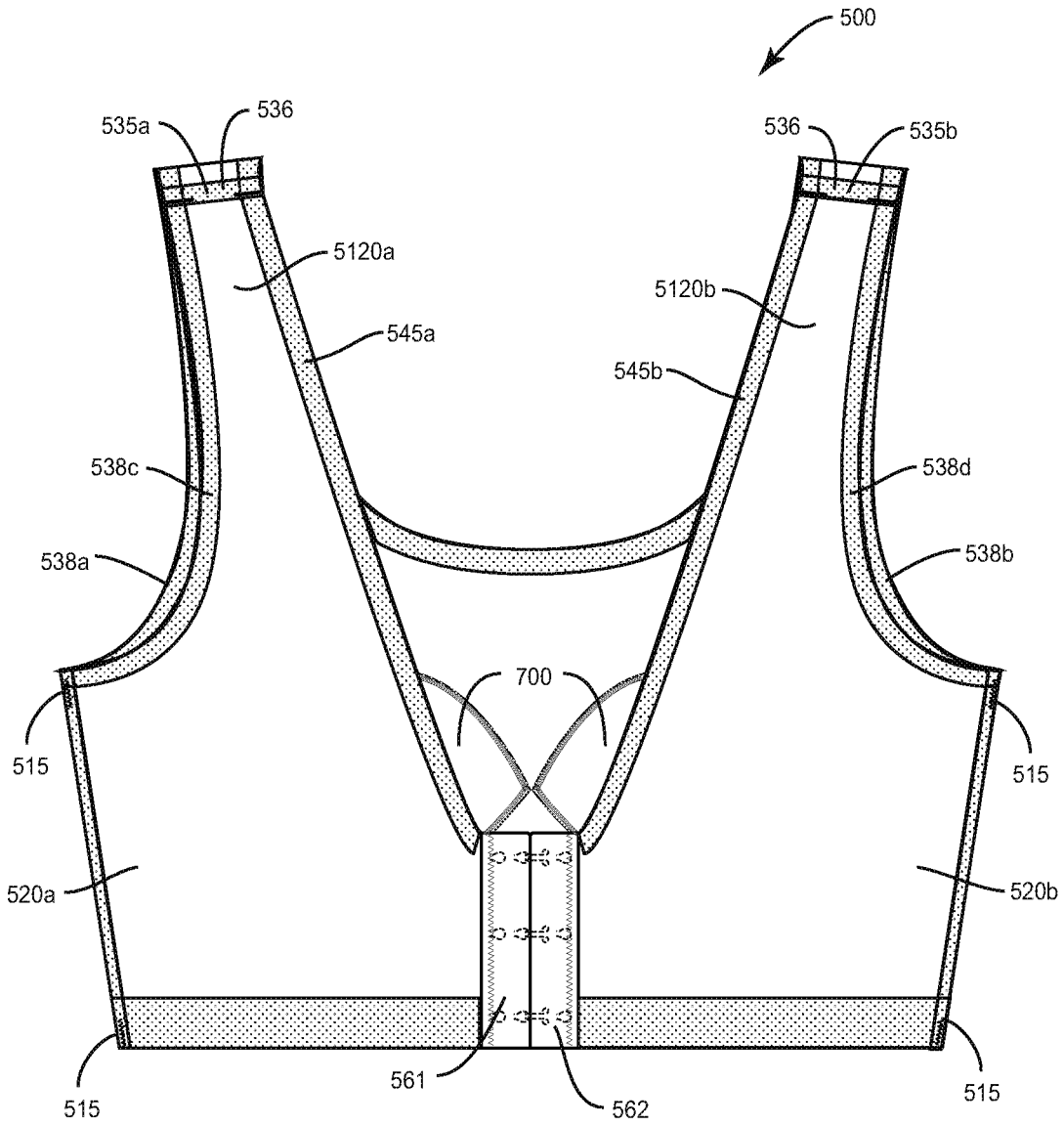
FIG. 6 is a rear view of the bra of FIG. 5.

Referring to FIG. 6, rear panels 520*a* and 520*b* include a pair of attachment members 561 and 562. Attachment members 561 and 562 are made to releasably attach to each other and can be in the form of a hook-and-loop closure, snaps, hook and eye closure and the like. Attachment members 561 and 562 can be attached to panels 520*a* and 520*b*, respectively, with flatlock stitching. Similarly, bra 100 can be formed with a rear closure with attachment members similar to members 561 and 562.

Figure 7:
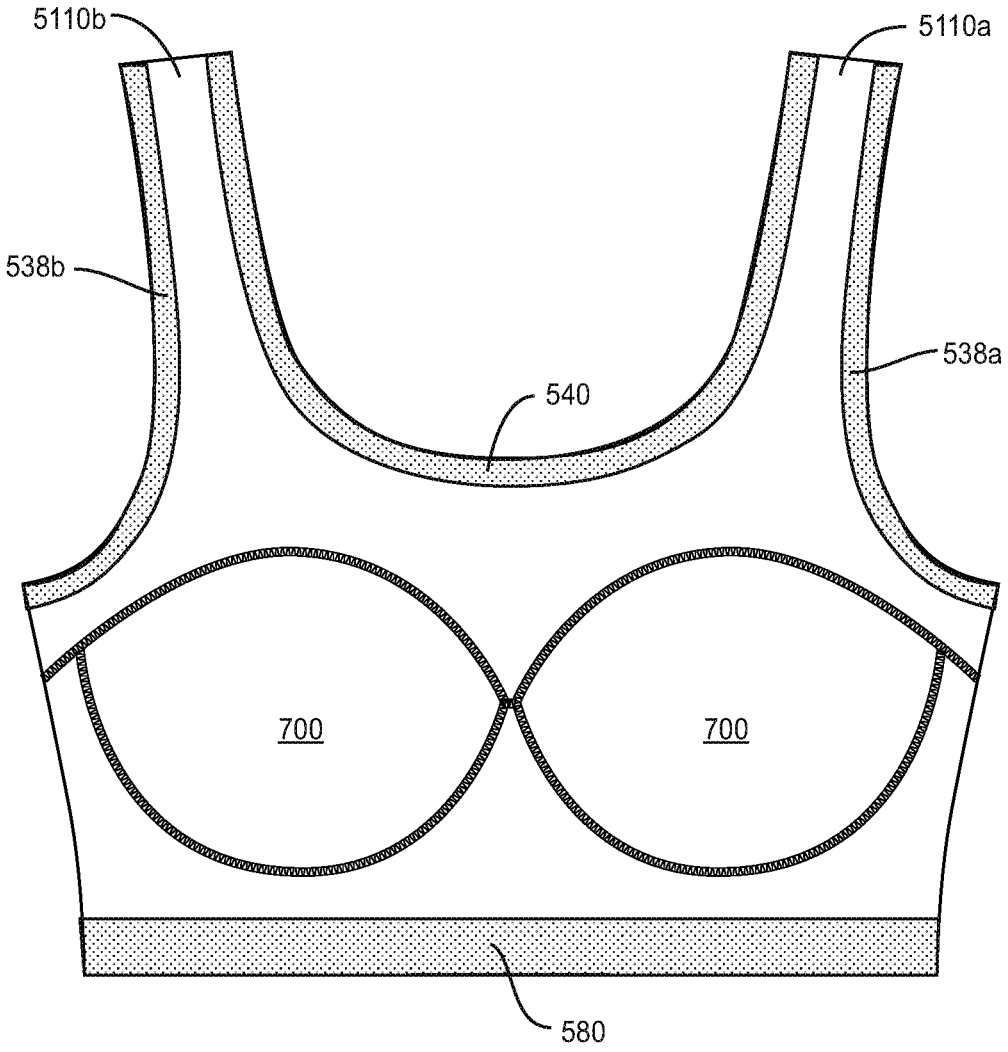
FIG. 7 is a partial rear view of the inside of the front panel of the bra of FIG. 5.
Figure 8:
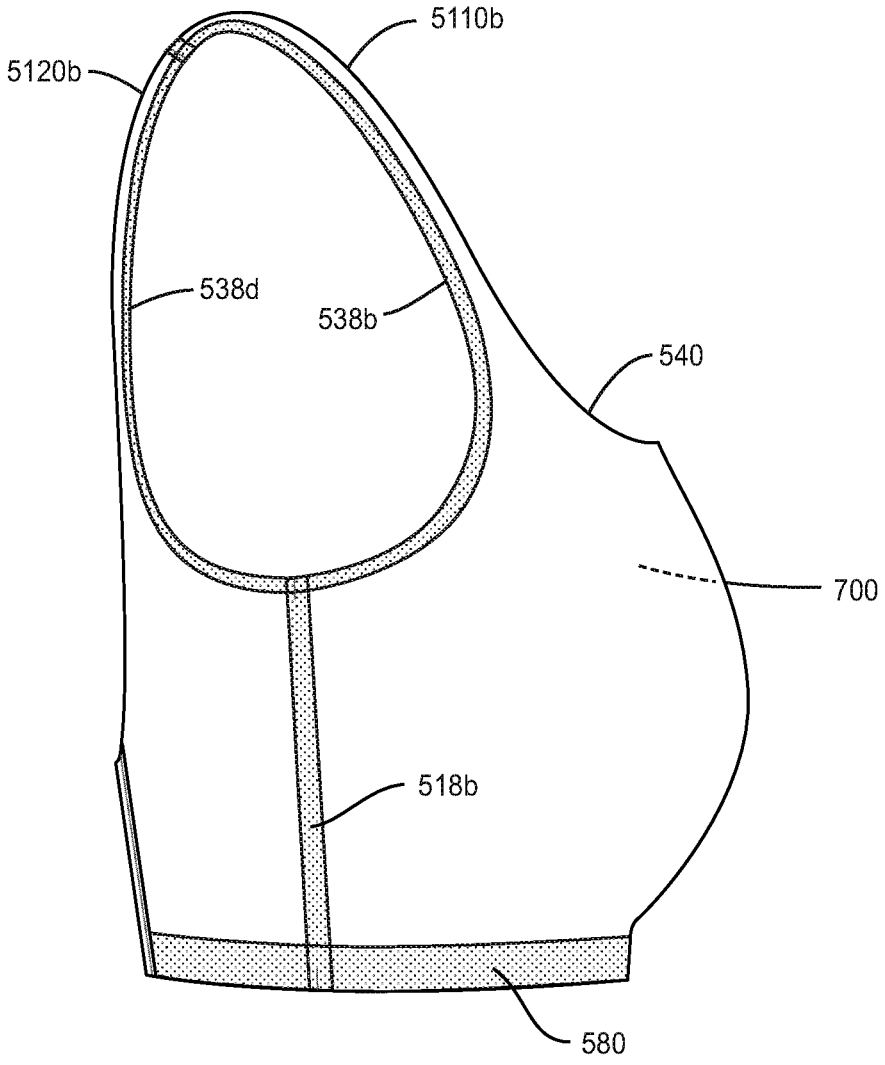
FIG. 8 is a side view of a bra of FIG. 5

Referring now to FIGS. 6 and 7, a pair of foam cups 700 are provided to support the breasts of a wearer/user. Cups 700 are attached to the inner surface of front panel 510, preferably by flatlock stitching. The fabric in front of cups 700 can be contoured for better shape and fit.

The fabric, formation method and adhesive strips for bra 500 can be essentially the same as those used in accordance with bra 100. The shoulder seam defining the arm holes preferably comprises an elastomeric adhesive. The adhesive is preferably 1.0-1.5 cm wide, preferably about one point to cm. The adhesive defining the neckline can be wider, preferably 1.0-1.8 cm wide, preferably 1.2-1.6 cm wide, most preferably about 1.4 cm wide. The fabric between the under bust section and the front neckline should be molded, to add preferred shaping. The bottom band is preferably about 1-2.5 cm wide, preferably 1.5-2.2 cm and most preferably about 2 cm. Other dimensions are acceptable.

The film at the edge defining the rear armhole and the rear neckline, can be about 1.25-2.0 cm, preferably about 1.4 or 1.5 cm. the side seam can be a 1.0-1.5 cm film, preferably 1.2-1.4 cm and most preferably about 1.3 cm. the closure member is preferably a hook and eye closure, most preferably including three rows and three columns of hooks and eyes. Other dimensions are acceptable.

The foam cups are preferably flatlock stitched to the inside layer of the front fabric. Thus, the stitching does not extend to the outer layer of the two-ply fabric comprising the front fabric panel. This helps promote a smooth appearance.

The body fabric is preferably 66% nylon, formed as a 20D nylon yarn combined with 34% 30D spandex. A 40 gauge knitting machine operating at 155 gsm is preferred. The same moisture management treatment as described above can be applied to the surface of the fabric of bra 500. Other fabrics are acceptable.

The elastomeric adhesive for bra 500 can be essentially the same as that used for bra 100. Preferred is a clear color adhesive, preferably an ester polyurethane. Preferred adhesive density is about 25-35 g/m, preferably about 30-32 g/m. it is preferably applied with a flat press machine. Other adhesives are acceptable.

It will thus be seen that the objects set forth above, among those made apparent from the preceding description, are efficiently attained, and, since certain changes may be made in carrying out the above method and in the article of manufacture set forth, without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A garment constructed to support a pair of breasts on a chest of a wearer wearing the garment, comprising:

a front body portion adapted to overlap the chest of the wearer and a rear body portion adapted to overlap a back of a wearer, the front body portion and rear body portion each having a top edge opposite a bottom edge, two opposite sides and an outer surface opposite an inner surface;

the front and rear body portions each having respective first and second shoulder strap extensions, each shoulder strap extension having respective inner edges facing each other to define a front neckline and a rear neckline, respectively and respective outer edges facing away from each other to define respective arm holes, the first and second front shoulder strap extensions joined to the respective first and second rear shoulder strap extensions forming first and second shoulder straps;

the front body portion joined to the rear body portion at the respective sides thereof;

the front body portion having edges formed with an inner and an outer layer of fabric attached substantially only at the edges thereof, the attachment of the inner and outer layers at the front neckline and arm holes consisting essentially of a strip of elastomeric adhesive at the edges of the layers defining the front neckline and arm holes; and the bottom edge of the front portion comprising a bottom band that is folded and secured upon itself with elastomeric adhesive.

2. The garment of claim 1, wherein the rear body portion comprises left and right halves, releasably secured with a releasable closure.

3. The garment of claim 2, wherein the closure is a hook and eye closure.

4. The garment of claim 1, wherein the rear body portion is formed with an inner and an outer attached layer of fabric, the attachment of the inner and outer layers at the rear neckline and arm holes consisting essentially of a strip of elastomeric adhesive at the edges of the layers defining the rear neckline and arm holes; and the bottom edge of the rear portion comprising a bottom, folded and secured with elastomeric adhesive.

5. The garment of claim 1, wherein the bottom edge of the front portion and rear portion comprises a bottom band consisting essentially of the bottom edge, folded and secured with elastomeric adhesive.

6. The garment of claim 1, wherein the edges of the front and rear portions are attached to each other with a strip of adhesive.

7. The garment of claim 6, wherein the adhesive strip of the bottom band is about 1 to 2.5 cm wide and adapted to help keep the bottom of the garment from riding up on a wearer.

8. The garment of claim 1, wherein the fabric comprises a nylon and spandex blend with at least 25% spandex.

9. The garment of claim 1, comprising cups secured to the inner layer of the front body portion and not the outer layer of the front body portion.

10. The garment of claim 9, wherein the cups are secured to the inner layer with flatlock stitching.

11. The garment of claim 10, wherein the flatlock stitching completely surrounds the cups.

12. The garment of claim 9, wherein the cups are formed from foam.

13. The garment of claim 9, wherein the cups comprise perforated foam pads covered with fabric.

14. The garment of claim 1, wherein the bottom band of adhesive is about 23-28 μm thick.

15. The garment of claim 1, wherein the adhesive strips attaching the inner and outer layers of the front portion have a density of about 25-35 $g/m^2$.

16. The garment of claim 1, wherein the adhesive strips attaching the inner and outer layers of the front portion comprise an ester modified polyurethane adhesive.

17. The garment of claim 1, wherein the fabric comprises 20D nylon and 30D spandex and is at least 15% spandex.

18. The garment of claim 14, wherein the fabric of the front portion has a density of about 145 to 165 $g/m^2$.

19. The garment of claim 18, wherein the fabric of the body portion has been treated with an amino modified hydrophilic silicone oil.

20. The garment of claim 13, wherein the rear body portion comprises left and right halves, releasably secured with a releasable closure.

* * * * *